United States Patent [19]

Leupold

[11] Patent Number: 4,994,778

[45] Date of Patent: Feb. 19, 1991

[54] ADJUSTABLE TWISTER

[75] Inventor: Herbert A. Leupold, Eatontown, N.J.

[73] Assignee: The United States of America as represented by the Secretary of the Army, Washington, D.C.

[21] Appl. No.: 436,408

[22] Filed: Nov. 14, 1989

[51] Int. Cl.[5] ..... H01F 700

[52] U.S. Cl. ..... 335/306; 335/212; 335/210; 315/5.28

[58] Field of Search ..... 335/302, 306, 300, 210, 335/212, 301, 304; 315/5.28, 5.35

[56] References Cited

U.S. PATENT DOCUMENTS

| | | | |
|---|---|---|---|
| 4,429,229 | 1/1984 | Gluckstern | 335/212 |
| 4,839,059 | 6/1989 | Leupold | 335/210 |

FOREIGN PATENT DOCUMENTS

| | | | |
|---|---|---|---|
| 62-98602 | 5/1987 | Japan | 335/306 |
| 02924 | 4/1988 | PCT Int'l Appl. | 335/306 |

OTHER PUBLICATIONS

K. Halbach, "Conceptual Design of a Permanent Quadrapole Magnet With Adjustable Strenths", *Nuclear Instruments and Methods*, 1983.

K. Halbach, "Conceptual Design of a Permanent Quadrupole Magnet With Adjustable Strength", Sep. 1982.

*Primary Examiner*—Leo P. Picard

*Assistant Examiner*—Trinidad Korka

*Attorney, Agent, or Firm*—Michael Zelenka; Judith A. Michal

[57] ABSTRACT

A permanent magnet structure comprising a linear array of hollow cylindrical flux source structures nested one within another about a common central axis. Each HCFS structure is free to displace linearly parallel to the central axis or to rotate about the axis. The array may be arranged by appropriate mechanical adjustment to provide periodic magnetic structures suitable for use as a wiggler or a twister.

6 Claims, 2 Drawing Sheets

λ/2
λ/2
λ
λ/4
101
102
103
104
201
202
201
202

ADJUSTABLE TWISTER

The invention described herein may be manufactured, used, and licensed by or for the Government for governmental purposes without the payment to me of any royalties thereon.

TECHNICAL FIELD

The present invention relates in general to permanent magnet structures for use in electronic devices which act as radiation sources and, more particularly, to magnet structures in wigglers and twisters.

BACKGROUND OF THE INVENTION

Many devices that employ magnetic fields have been encumbered by massive solenoids accompanied by bulky power supplies. However, permanent magnet structures can provide compact, strong, static magnetic fields that do not require the use of additional power supplies. Thus, there has been increasing interest in applications using permanent magnet structures. Often these permanent magnet structures must be designed in unusual configurations. A number of configurations have been designed and developed for electron beam guidance in electron beam tubes of various types. Especially promising for such purposes is the configuration based upon the hollow cylindrical flux source (HCFS) described by K. Halbach in "Proceedings of the Eighth International workshop on Rare Earth Cobalt Permanent Magnets", Univ. of Dayton, Dayton, Ohio, 1985 (pp. 123–136). A hollow cylindrical flux source (HCFS), sometimes called a "magic ring", is a cylindrical permanent magnet shell which produces an internal magnetic field that is more or less constant in magnitude across the central cavity. The field is perpendicular to the central, longitudinal axis of the cylinder, and furthermore the field strength can be greater than the remanence of the magnetic material from which the ring is made. No magnetic flux extends to the exterior of the HCFS structure except at the ends of a finite cylinder. The ideal HCFS is an infinitely long, annular cylindrical shell with a circular cross section. However, the aforementioned Halbach publication discloses an HCFS structure with an octagonal cross section which closely approximates the performance and field pattern of an ideal HCFS. The "HCFS structure" as used herein encompasses not only the ideal cylindrical structure but also other polygonal sided structures which behave with the characteristics of an HCFS.

Recently, HCFS structures have been applied to the design of wigglers and twisters. Reference may be had to "Applications of yokeless flux confinement", J. Appl. Phys. 64(1)), 15 Nov. 1988 for example. More specifically of interest in this regard is applicant's U.S. Pat. No. 4,862,128 entitled "Field Adjustable Transverse Flux Sources" on which the invention of the instant application is an improvement. A wiggler is a radiation source. In wiggler operation, an electron beam is injected into a drift region which is surrounded by a periodic magnet source. The periodic magnet source creates a magnetic field which varies in direction by 180° at fixed intervals, yet is always perpendicular to the principal direction of electron beam travel. A twister is also a radiation source. In twister operation, an electron beam is injected into a drift region in which there is a transverse magnetic field of constant magnitude whose direction changes continuously with progression along the axis, thereby forming a helical field configuration with either constant or progressive pitch. The central cavity of the HCFS structure functions as a drift region in those wigglers and twisters using these HCFS configurations.

SUMMARY OF INVENTION

It is an object of this invention to provide a permanent magnet structure which by simple mechanical adjustment of the apparatus may be used to individually produce both the necessary magnetic field patterns required in either a wiggler or a twister.

It is another object of the invention to provide a permanent magnet structure wherein the interior magnetic flux can be varied continuously from zero to a maximum field when used in the wiggler configuration.

This object and other objects are achieved in accordance with the present invention, which makes advantageous use of multiple HCFS structures uniquely combined to create an adjustable apparatus with dual functioning capabilities.

The present invention comprises a linear array wherein each of the components of such array are composed of a plurality of truncated, concentric, hollow cylindrical flux source structures such that the HCFS structures have a common longitudinal central axis in the central cavity and such that the outer radius of each HCFS structure beginning with the innermost structure substantially equals the inner radius of the immediately adjacent larger structure. Structures in this configuration will be termed "nested structures." The present invention is so constructed that each HCFS structure can be rotated about the central axis and can be displaced linearly parallel to the direction of the central axis.

The HCFS structures are characterized by their ability to add magnetic fields vectorially. Therefore, the resultant field in the central cavity is the vector sum of the fields generated in the central cavity by each of the component HCFS structures working independently.

In the preferred embodiment of the present invention, the plurality of truncated, nested HCFS structures are limited to a pair of nested HCFS structures comprising an inner and an outer HCFS structure. Nested pairs of HCFS structures are arranged in a linear array along a longitudinal central axis. Each HCFS structure is designed to be of a width equaling one half the period of the desired modulatition waveform, i.e. $\lambda/2$. Each HCFS structure is designed to independently generate a field of a magnitude equal to that of each of the other HCFS structures in the linear array. There are two configurations of the preferred embodiment which allow the present invention to function both as a wiggler and as a twister. Configuration changes which afford the two preferred modes of operation are achieved by simple mechanical adjustment of the device.

In one configuration, the inner HCFS structures of the array are oriented so that the magnetic vector components in the central cavity caused by adjacent HCFS structures are 180° apart. That is, the interior magnetic field components of adjacent inner HCFS structures alternate in direction. The outer HCFS structures are positioned directly above the inner segments, that is, relative linear displacement between inner and outer segments in each pair is zero. The outer segments of the array are also oriented so that the magnetic vector components in the central cavity caused by adjacent HCFS structures are 180° apart. That is, interior magnetic vector components of adjacent outer segments alternate in direction. In this configuration, the present invention is composed of a pair of nested wigglers. The resultant function for the device as a whole is wiggler operation. By rotation of either all inner or all outer HCFS structures or both the field may be made to vary continuously from zero to a maximum for the device. Thus, the apparatus when in this configuration can function as a field variable wiggler. To maximize the magnetic fields in the central cavity, the magnetic field components of inner and outer rings can be aligned.

It is an advantageous feature of the present invention that mechanical adjustment permits the present invention to also function as a twister. Assuming that the apparatus as described has been oriented to produce maximum magnetic fields in the central cavity by alignment of the magnetic vector components in each of the pairs, then a simple, specific relative linear displacement and rotation will convert the apparatus from operating in a wiggler mode into operating in a twister mode. More specifically, by displacing either all the outer HCFS structures or all the inner HCFS structures by one quarter period in a direction parallel to the central axis of the linear array and by rotating either all the outer HCFS structures or all the inner HCFS structures by 90° around the central axis of the linear array, the structure may be configured to function in the twister mode. In this configuration of the preferred embodiment, the pattern of the magnetic field components in the central cavity is one of two substantially sinusoidal waves whose vibrational directions are at right angles to each other and with the same direction of propagation. The sine waves are 90° out of phase and have the same amplitude. Whenever two sine waves are so defined, the resultant vector forms a helix pattern, which is the field pattern in the drift region of a twister. Therefore this invention allows for conversion between a wiggler mode and a twister mode by simple mechanical adjustment. It is this simple mechanical adjustment enabling the invention to be readily changed from a wiggler to a twister which comprises the primary advantage over that invention described in applicant's U.S. Pat. No. 4,862,128. This simplicity of adjustment is brought about by this invention's ability to provide relative linear displacement of the inner and outer HCFS structures. In the preferred embodiment, two nested wigglers are used. Thus the device can be termed an "adjustable biwiggler twister."

BRIEF DESCRIPTION OF THE DRAWINGS

The invention will be more fully appreciated from the following detailed description when the same is considered in connection with the accompanying drawings in which:

FIG. 1 illustrates a wiggler mode configuration of the present invention. The drawing shows the magnetic field orientations internal to the HCFS structures and also the magnetic field orientations in the central cavity.

DETAILED DESCRIPTION OF THE DRAWINGS

Figures 1, 2:
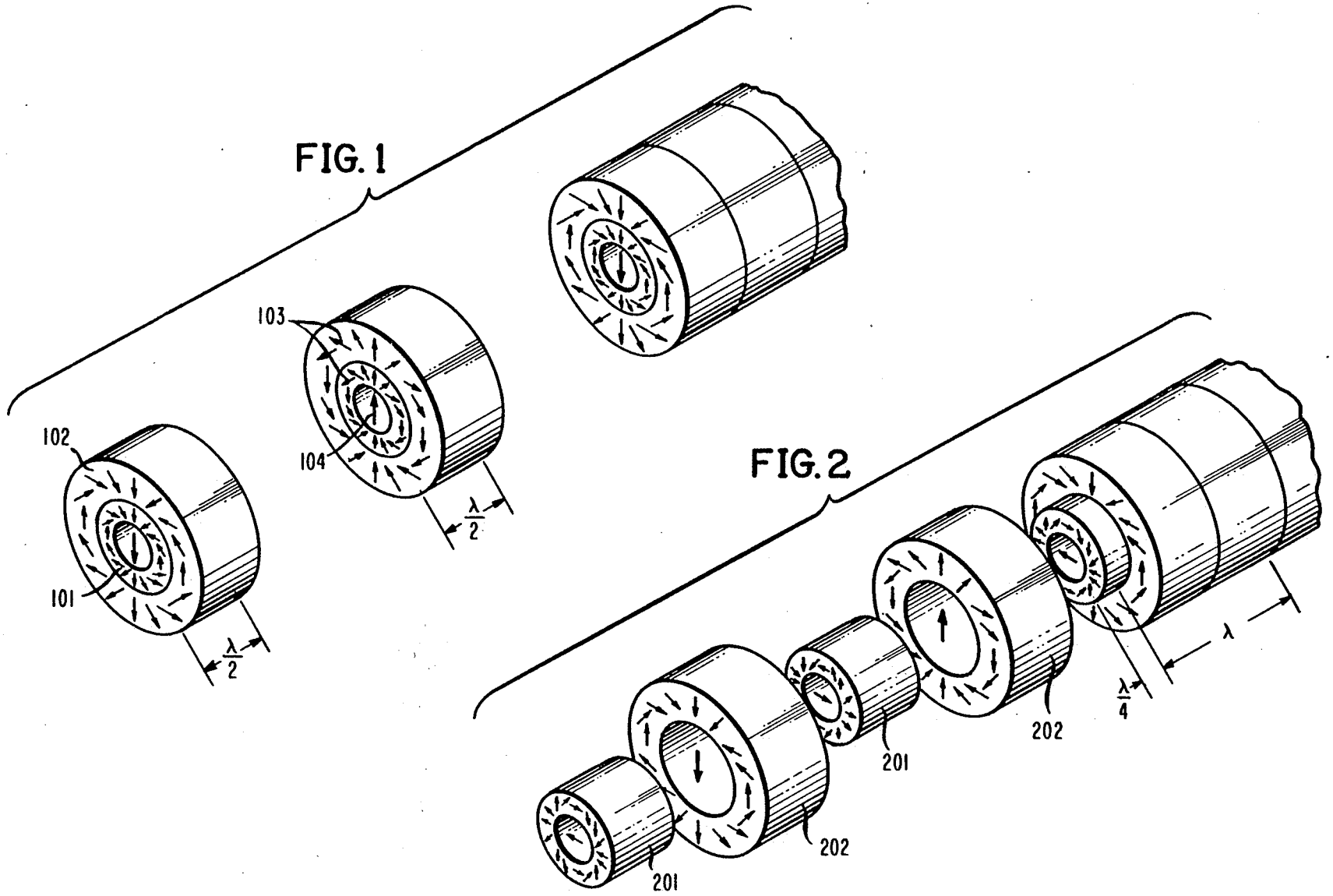
FIG. 1 is an exploded schematic diagram of a preferred embodiment of the present invention showing pairs of nested, truncated, hollow cylindrical flux sources structures arranged in a linear array. A common longitudinal central axis is assumed to run the length of the central cavity of the linear array but is not shown.
FIG. 2 is an exploded diagram of the twister mode configuration of the present invention.

FIG. 1 shows an exploded view of the preferred embodiment of the present invention in one of two preferred configurations of that embodiment. The preferred embodiment comprises a linear array of nested pairs of truncated hollow cylindrical flux source structures, 101 and 102. Inner HCFS structures are denoted by 101; outer structures by 102. Each HCFS structure has a width equal to one half period of the modulation waveform, i.e. $\lambda/2$. Arrows 103 illustrate the magnetic orientations of the fields interior to the HCFS structures. The resultant fields in the central cavity are represented by arrows 104.

The magnetic field strength $\vec{H}_w$ independently produced by each HCFS structure is assumed to be known. Design procedures known to those skilled in the art permit one to calculate the magnetic field strength within the central cavity of an HCFS structure when the inner and outer radii of the structure are known, together with the remanence, $B_r$, of the magnetic material comprising the HCFS structure. For example, for an ideal, infinitely long HCFS, the magnetic field strength is given by $$\vec{H}_w = \vec{B}_r \ln (r_2/r_1)$$

where $r_2$ = outer radius of the HCFS $r_1$ = inner radius of the HCFS $B_r$ = remanence of the HCFS material In accordance with the present invention, the magnetic field strengths $\vec{H}_{w1}$ and $\vec{H}_{w2}$ add vectorially. That is, $H_w = \vec{H}_{w1} + \vec{H}_{w2}$.

In the preferred embodiment of the present invention, the magnitudes of the field strengths of the structures are designed to be equal.

Each inner HCFS structure, 101, is oriented such that the pattern of vector components in the central cavity from the inner HCFS structures varies by 180° going from inner structure to inner structure. The outer HCFS structures, 102, are also arranged to alternate in direction. Therefore the present configuration comprises a pair of nested wigglers. The magnetic field components of the HCFS structures of each nested pair add as vectors. Therefore, the resultant in the central cavity also alternates by 180° with progression along the length of the linear array. Thus, the present invention can function as a wiggler. Since the HCFS structures can rotate, the magnitude of the field in the central cavity can vary. In FIG. 1 the inner and outer HCFS structures are positioned by appropriate rotations to cause maximum field magnitudes by aligning the components of inner and outer structures.

The terms HCFS, HCFS structure, and "magic ring" encompass not only the ideal cylindrical structure in which mathematically the azimuthal field dependence is assumed continuous but also segmented approximations in which each segment has the magnetization constant in both amplitude and direction within any one segment. The invention is not limited to any specific number of segments and the greater the number of segments the closer the approximation to the ideal case. The "HCFS structure" as used herein encompasses not only the ideal cylindrical structure but also polygonal sided structures.

As is evident to those skilled in the art, there are many ways to structurally mount the magnets of the present invention. For example, the magnetically active structures may be mounted on hollow cylinders of non-magnetic material such as stainless steel or brass. The ends of these cylinders can project from either/or both ends of the magnetic array. At the ends, they may be hollow or solid. The cylinder may be attached to some means of rotation such as a motor. A ball detent may be used as a locating mechanism to set the array either circularly and/or longitudinally at the correct positions.

Although circular and polygonal sided HCFS structures are described, as will be evident to those skilled in the art, the principle does not depend on HCFS structures for its application. Any magnetic slice that produces a transverse magnetic field and is free of iron or other soft magnetic material can be used.

FIG. 2 illustrates an exploded view of the preferred embodiment in another preferred configuration. As in FIG. 1, each inner HCFS structure, 201, is oriented such that the field components in the central cavity of the inner HCFS structures alternate in direction going from inner structure to inner structure. A similar pattern exists for the set of outer HCFS structures 202. Therefore, this configuration is also characterized as a pair of nested wigglers. However, there is a relative displacement and a relative rotational difference between inner and outer structures which distinguishes the position shown in FIG. 2 from that shown in FIG. 1.

There is a relative displacement of one quarter period ($\lambda/4$) as shown and a relative rotational change of 90°.

Displacement and rotation form the basis for variation of the field magnitude and direction in the central cavity of the present invention. Displacement by $\lambda/4$ and rotation by 90° affords the conversion of the device from the wiggler mode to the twister mode and the reverse. To understand how the configuration shown in FIG. 2 functions as a twister, reference should be made to FIGS. 4 and 5 and to the accompanying discussion.

Figure 3:
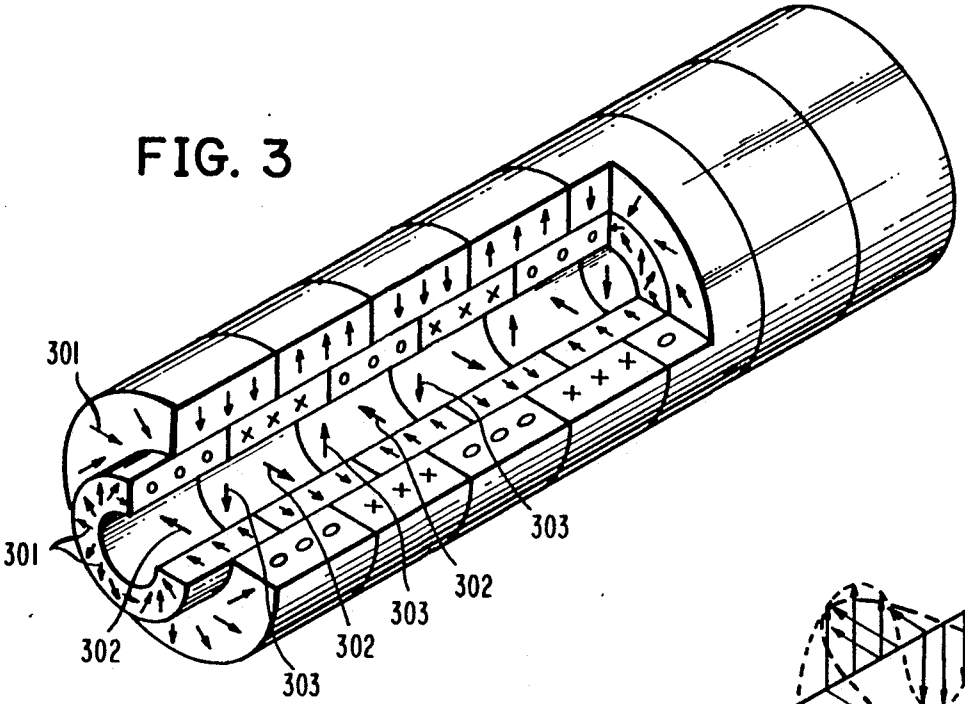
FIG. 3 is an compacted diagram of the exploded view of the twister mode configuration as shown in FIG. 2.

FIG. 3 illustrates a cut-away view of the configuration pictured in FIG. 2. The magnetization orientations, 301, within the HCFS structures are shown. The magnetic field orientations created in the central cavity by the inner HCFS structure are given by vectors, 302, and those of the outer HCFS structures by vectors, 303.

For each HCFS structure a maximum field in the central cavity is achieved at the midpoint of the structure. The field tapers to a minimum at the ends of the structures. This variation in the magnitude of the magnetic fields occurs because the HCFS structures have been truncated to a finite length and end effects are present, and there is also interference between adjacent structures. The variation of the field strength in the central cavity from each HCFS structure traces a sine wave. Both inner and outer HCFS structures exhibit this sine wave pattern. The component fields superimpose.

Figure 4:
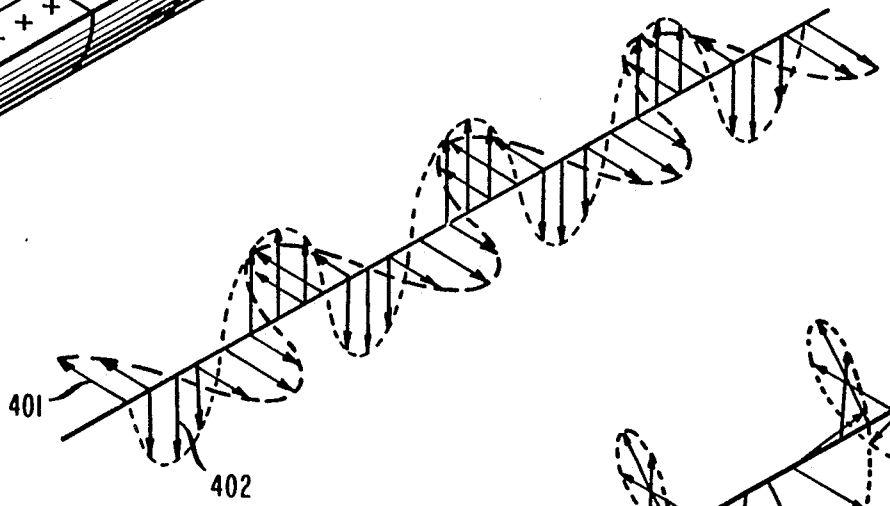
FIG. 4 is a vector diagram of the magnetic field components of the inner and outer HCFS structures positioned in the twister mode configuration illustrated in FIGS. 2 and 3.

FIG. 4 is the vector diagram of the field components of inner and outer sets of HCFS structures in the configuration shown in FIGS. 2 and 3. Vectors, 401, are components of the inner segments; vectors, 402, are those of the outer structures. Two sine waves are traced. The sine waves have vibrational directions at right angles to each other and with the same direction of propagation. They are 90° out of phase and have the same amplitude.

Figure 5:
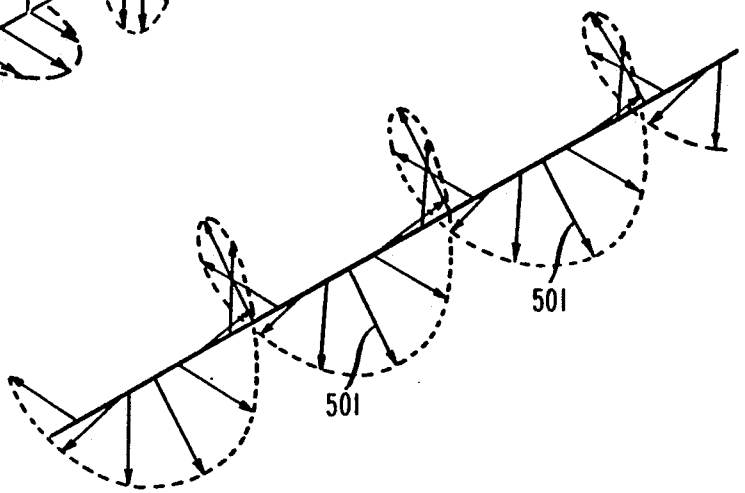
FIG. 5 is the vector diagram of the resultants of the components of the inner and outer HCFS structures positioned in the twister mode configuration as illustrated in FIGS. 2 and 3.

FIG. 5 shows the resultants, 501, of the components described in FIG. 4. A helix is traced.

Therefore a twisted helically oriented magnetic field of constant magnitude is formed along the length of the central axis. If an electron beam is passed through the central cavity, the device is a "twister." For a more detailed description of a twister, reference can be had to my co-pending application, Ser. No. 316,374, filed Feb. 24, 1989.

To summarize, using the preferred embodiment of the present invention as described, a relative linear displacement of $\lambda/4$ and a relative rotational displacement of 90° between inner and outer HCFS structures enables the present invention to alternate reversibly between wiggler and twister modes.

Other and different approximations to the adjustable twister may occur to those skilled in the art. Accordingly, having shown and described what is at present considered to be a preferred embodiment of the invention, it should be understood that the same has been shown by way of illustration and not limitation. And, all modifications, alterations, and changes coming within the spirit and scope of the invention are herein meant to be included.

WHAT IS CLAIMED IS:

1. A convertible magnetic structure which creates a magnetic modulation waveform for use in a field variable wiggler and twister comprising a linear array wherein each of the components of said array are composed of a plurality of truncated, concentric, hollow cylindrical flux source (HCFS) structures nested one within another such that the HCFS structures have a common longitudinal central axis in the central cavity, the outer radius of each HCFS structure beginning with the innermost HCFS structure being substantialy equal to the inner radius of the immediately adjacent larger HCFS structure, each HCFS structure being free to displace linearly with respect to the HCFS structure with which it is nested in a dirction parallel to the central axis, and also to rotate about said axis by any angular amount.

2. A magnetic structure as defined in claim 1 wherein said plurality of HCFS structures comprises a pair of said HCFS structures.

3. A magnetic structure as defined in claim 2 wherein the direction of the magnetic fields in the central cavity are perpendicular to the common longitudinal central axis of the array.

4. A magnetic structure as defined in claim 3 wherein each of the truncated HCFS structures independently produces a magnetic field in the central cavity equal to that produced by each of the other HCFS structures in the array.

5. A magnetic structure as defined in claim 4 wherein each HCFS structure has a width equal to one half period of the modulation waveform.

6. A magnetic structure as defined in claim 5 wherein the magnetic modulation waveform in the central cavity in said array defines a helical locus.

* * * * *